US008047702B1

(12) United States Patent
LoPresti

(10) Patent No.: US 8,047,702 B1
(45) Date of Patent: Nov. 1, 2011

(54) CONTINUOUS HIGH SHEAR MIXING PROCESS

(76) Inventor: William J. LoPresti, Marietta, GA (US)

( * ) Notice: Subject to any disclaimer, the term of this patent is extended or adjusted under 35 U.S.C. 154(b) by 1050 days.

(21) Appl. No.: 11/448,165

(22) Filed: Jun. 6, 2006

Related U.S. Application Data

(60) Provisional application No. 60/687,329, filed on Jun. 6, 2005.

(51) Int. Cl.
*B01F 7/16* (2006.01)

(52) U.S. Cl. ..... 366/153.1; 366/182.2; 366/182.4; 366/191; 366/194

(58) Field of Classification Search ..... 366/153.1, 366/182.2, 182.4, 191, 194
See application file for complete search history.

(56) References Cited

U.S. PATENT DOCUMENTS 2,350,044 A * 5/1944 Kantor ..... 366/162.2
3,314,398 A * 4/1967 Legourd ..... 119/71
4,828,865 A 5/1989 Kohlstette et al.
4,886,574 A 12/1989 Grant
4,946,702 A 8/1990 Stipp et al.
5,188,857 A 2/1993 Grant
5,206,047 A 4/1993 Crandall et al.
5,908,240 A * 6/1999 Hood ..... 366/18
5,935,332 A * 8/1999 Caucal ..... 118/429
5,951,161 A * 9/1999 Blagg ..... 366/152.6

FOREIGN PATENT DOCUMENTS

CA D10-14-4 8/2002

* cited by examiner

*Primary Examiner* — David Sorkin
(74) *Attorney, Agent, or Firm* — James Creighton Wray

(57) ABSTRACT

A high shear mixer in a holding tank is used in a continuous flow process. Flow rate of material into and out of the holding tank establishes residence time in contact with shearing elements. A batch shear mixer is used in a tank that has continuous flow into the bottom and out of the top. A level controller controls a valve or a positive displacement pump at the inlet. The mixing chamber is sized for the maximum needed residence time, slowing the flow increases the residence time. In an open tank lower inlet pump and upper outlet pump are coordinated. Incoming flow rate matches outgoing flow for continuous processing.

13 Claims, 5 Drawing Sheets

CONTINUOUS HIGH SHEAR MIXING PROCESS

This application claims the benefit of U.S. Provisional Application No. 60/687,329, filed Jun. 6, 2005, which is hereby incorporated by reference in its entirety.

BACKGROUND OF THE INVENTION

Many different types of concentrate bases and single strength juices are processed through a homogenizer to reduce pulpy fiber and make a uniform blend or puree. Pulpy juices are often homogenized to reduce particle size of the pulp and thus the apparent viscosity, such as "tight-end pulp" from a juice finisher.

Juice processing often requires both homogenization and high shear to create juice concentrates, concentrate bases, and slurries. Homogenization and high shear are required to reduce viscosity, eliminate undesirable insoluble particles (imperfections), and reduce the size of pulp and other fibers that are present in single strength or concentrate juices. Typically, juice concentrates are shear thinning thixotropic liquids. Reducing the viscosity reduces pressure drops in product pipelines and makes pumping easier. Reduced viscosity assists in the evaporation process and product dispensing, especially when high pectin is present.

Examples in juice and beverage processing include:

1. Reduction of viscosity of orange and grapefruit juices in a taste evaporator while minimizing insoluble imperfections. Current technology uses high-pressure piston style homogenizers placed within the evaporator between stages.

2. Reduction of particle size of pulp and/or fiber in orange and grapefruit juices, as well as a wide variety of concentrate bases and purees. The reduction is normally required for improved appearance and mouth feel. Current technology uses high-pressure piston style homogenizers placed after juice extraction and finishing.

3. Reduction of particle size of pulp in concentrate bases and single strength juices for permitting these products to be heated and/or cooled in a plate type heat exchanger. The plate type heat exchangers are restricted to products containing specifically sized particles.

4. Creation of stable oil/aqueous phase emulsion in blending citrus oils and other flavors as ingredients into a blended recipe. Flavor and minor component ingredient incorporation into blends are often problematic unless high-pressure homogenization is used. Many smaller companies accept a lesser quality product because of the high capital and maintenance costs of the equipment.

In many of the above processes, the current technology typically uses a high-pressure homogenizer. The high-pressure homogenizer uses a high-pressure piston pump to elevate the pressure of the liquid. A homogenizing valve discharges the liquid. The conventional homogenizer is expensive and consumes large amounts of horsepower because the required discharge may be in the approximately 2500 to 5000 psi range.

The use of batch type shear mixers is not practical in most cases because processes must be continuous flow. Replacing the homogenizer with an inline mechanical high shear pumping device is also not usually viable. Although mechanical shearing may be an alternative to the much higher shear homogenizing device, it requires much greater residence times. The inline mixer, even with multiple staging, cannot control the residence time.

While batch mechanical shear mixing and homogenization are easily scaled up from lab tests, it is difficult to predict the results achieved when the scale up involves inline mechanical shear mixing using a shear pumping device.

These same problems extend to the production of chemical solutions, micron-scale polymer beads, emulsions, suspensions, and other products that require blending, homogenizing, solubilizing, dispersion, or reduction of particle size.

Needs exist for improved and less expensive devices and methods to replace costly homogenizers.

SUMMARY OF THE INVENTION

The present invention is a modified batch-type shear mixer for replacing more costly homogenizer devices. Uses include, but are not limited to, production of single strength concentrates, juices from concentrates, concentrate bases, slurries, emulsions, solutions, and micron-scale polymer beads. The present device can be used with both Newtonian and non-Newtonian liquids and with some solids. The present device is more economical that existing homogenizer devices. Reductions in capital costs and energy expenditures are possible.

The present invention provides residence/retention time in contact with the shearing elements required to achieve a desired end product result. The process entails setting the flow rate of the liquid to the criteria for the desired product.

A first embodiment is an apparatus for preparing juice or beverages or any other product that requires homogenization, reduction of particle size, blending, solubilizing, dispersion, suspension, or emulsification. The vessel is sized for the maximum needed residence time and is preferably not open to atmosphere. The mixing chamber incorporates a batch shear mixer in a tank with a pressure seal that allows continuous flow. The device includes a product inlet, a holding tank connected to the product inlet, a product shear mixer mounted in the holding tank, a motor connected to the shear mixture for rotating the shear mixer in the holding tank, and a product outlet connected to the holding tank for continuously and constantly flowing the product from the holding tank. The holding tank has a top and a bottom and the product inlet is connected near a bottom of the holding tank and the product outlet is connected near a top of the tank. The device also has a metered ingredient injector connected to the product inlet near the holding tank.

Flow enters the bottom of the mixing chamber and exits the top, maintaining a constant volume. The volume of the chamber is sized based on required flow rates, and residence time is determined to provide adequate high shear mixing.

In another embodiment, pumps pump into the top of the mixing chamber ad flow exits the bottom of the tanks. The device is used with various products and/or variable flow rates. The vessel is sized for the maximum needed residence time and is preferably open to atmosphere. Pressure and vacuum vessels may be used depending on the process. The mixing chamber incorporates a batch shear mixer in a tank. A level controller controls a valve or a positive displacement pump at the inlet. Systems are designed for use with various products and flow rates by sizing the mixing chamber for the maximum needed residence time, opening the vessel to the atmosphere and installing a level monitor in the tank. The volume, determined by the level, serves a controlled process variable for residence time control. A variable speed extraction pump controls the level on a closed loop control. When the incoming flow rate matches the outgoing, the conditions are met for continuous processing.

The basic device includes a control valve connected between the product inlet and the holding tank for controlling a level of the product in the product holding tank, a level controller connected to the product holding tank and to the control valve for controlling the control valve, and an inlet pump connected between the product inlet and the control valve for supplying the product to the control valve and to the holding tank. The inlet pump is preferably a centrifugal pump. This embodiment may also include an outlet pump connected between the holding tank and the product outlet for pumping the product out of the holding tank. The outlet pump is preferably a centrifugal pump. The control valve is connected near a top of the holding tank and the outlet pump and the product outlet are connected near a bottom of the holding tank.

In another embodiment, the basic device includes a positive displacement pump connected between the product inlet and the holding tank, a level controller connected to the holding tank and connected to the inlet positive displacement pump for controlling liquid level in the holding tank, and an outlet positive displacement pump connected between the holding tank and the product outlet.

In another embodiment, the basic device has a holding tank that is pressurized instead of open to atmosphere. The pressure of the tank forces the output product through the outlet at the desired rate and no outlet pump is required.

The present invention also includes a method of providing juice or beverages or any other product that requires homogenization, reduction of particle size, blending, solubilizing, dispersion, suspension, or emulsification. The process includes providing a product inlet, providing a holding tank connected to the product inlet, providing a product shear mixer mounted in the holding tank, providing a motor connected to the shear mixer for rotating the shear mixer in the holding tank, providing a product outlet connected to the holding tank for continuously and constantly flowing the product from the holding tank, and providing an ingredient injector connected to the product inlet near the holding tank. The holding tank has a top and a bottom and the product inlet is connected near a bottom of the holding tank and the product outlet is connected near a top of the tank.

A residence time T is determined. The residence time T in the holding tank is determined with the following equation: $T=V/Q$, where V is the volume of product in gallons within the holding tank, Q is the output flow rate of the product output in gallons per minute, and T is the residence time within the tank in minutes.

In an alternative embodiment, the basic method also includes providing a control valve connected between the product inlet and the holding tank for controlling a level of the product in the product holding tank, providing a level controller connected to the product holding tank and to the control valve for controlling the control valve, providing an inlet pump connected between the product inlet and the control valve for supplying the product to the control valve and to the holding tank, wherein the inlet pump is a centrifugal pump, providing an outlet pump connected between the holding tank and the product outlet for pumping the product out of the holding tank, wherein the outlet pump is a centrifugal pump, and wherein the control valve is connected near a top of the holding tank and the outlet pump and the product outlet are connected near a bottom of the holding tank.

In this embodiment, $Q=Q_1=Q_2$, where Q is the output flow rate of the product output in gallons per minute, $Q_1$ is the input flow rate in gallons per minute and $Q_2$ is a fixed output rate in gallons per minute.

In an alternative embodiment, the basic method also includes providing a positive displacement pump connected between the product inlet and the holding tank, providing a level controller connected to the holding tank and connected to the inlet positive displacement pump for controlling liquid level in the holding tank, and providing an outlet positive displacement pump connected between the holding tank and the product outlet.

Here, $Q=Q_1=Q_2$, where Q is the output flow rate of the product output in gallons per minute, $Q_1$ is the input flow rate in gallons per minute and $Q_2$ is a fixed output rate in gallons per minute.

In addition to particle size reduction and viscosity applications, dry solids incorporation is aided by mixing with predetermined residence times. Oil based flavor additives injected into juice streams benefit by employing predictable and adequate residence times to ensure two phase emulsions. Where multiple stage homogenizations are required to achieve a specific size emulsion, shear mixing with residence time makes single stage homogenization viable.

The present invention allows replacement of conventional homogenization with lower capital costs and energy savings.

These and further and other objects and features of the invention are apparent in the disclosure, which includes the above and ongoing written specification, with the drawings.

DETAILED DESCRIPTION OF THE PREFERRED EMBODIMENTS

The present invention is a modified batch-type shear mixer for replacing more costly homogenizer devices. Uses include, but are not limited to, production of single strength concentrates, juices from concentrates, concentrate bases, slurries; emulsions, solutions, and micron-scale polymer beads. The present device can be used with both Newtonian and non-Newtonian liquids and with some solids. The present device is more economical that existing homogenizer devices. Reductions in capital costs and energy expenditures are possible.

The present invention provides residence time in contact with shearing elements required to achieve a desired end product result. The process entails setting the flow rate of the liquid to the criteria for the desired product.

Figure 1:
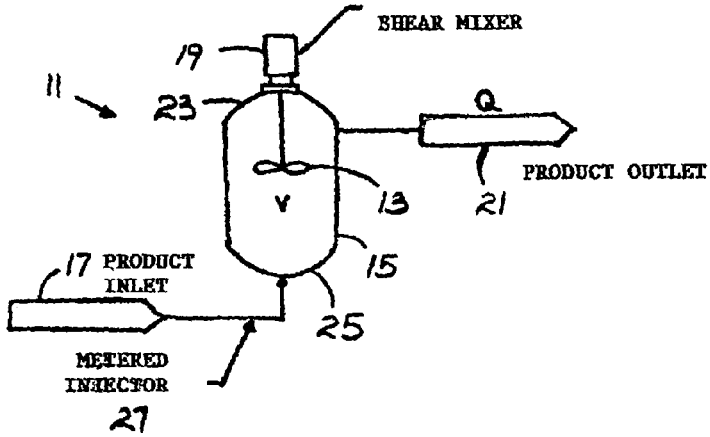
FIG. 1 is a schematic diagram of a constant flow embodiment.

FIG. 1 is a schematic diagram of a constant flow embodiment 11 for an apparatus for preparing juice or beverages or any other product that requires homogenization, reduction of particle size, blending, solubilizing, dispersion, suspension, or emulsification. The vessel 11 is sized for the maximum needed residence time and is preferably open to atmosphere. The mixing chamber incorporates a batch shear mixer 13 in a tank 15 with a pressure seal that allows continuous flow. The device includes a product inlet 17, a holding tank 15 connected to the product inlet 17, a product shear mixer 13 mounted in the holding tank 15, a motor 19 connected to the shear mixer 13 for rotating the shear mixer 13 in the holding tank 15, and a product outlet 21 connected to the holding tank 15 for continuously and constantly flowing the product from the holding tank 15. The holding tank has a top 23 and a bottom 25 and the product inlet 17 is connected near a bottom 25 of the holding tank 15 and the product outlet 21 is connected near a top 23 of the tank 15. The device 11 also has a metered ingredient injector 27 connected to the product inlet 17 near the holding tank 15.

Flow enters the bottom 25 of the mixing chamber 15 and exits the top 23, maintaining a constant volume. The volume of the chamber 11 is sized based on required flow rates, and residence time is determined to provide adequate high shear mixing.

Figure 2:
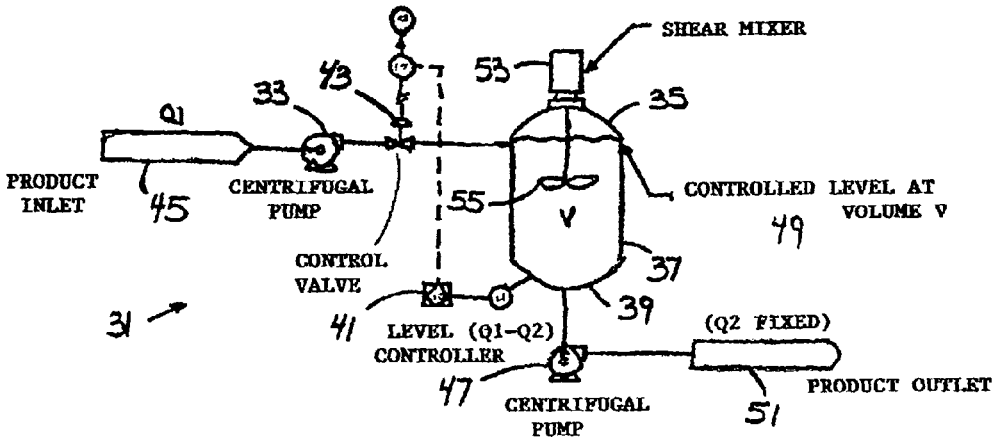
FIG. 2 is a schematic diagram of a variable flow embodiment for low viscosity.

FIG. 2 is a schematic diagram of a variable flow embodiment 31 for low viscosity. Pumps 33 pump into a top 35 of a mixing chamber 37 and flow exits a bottom 39 of the tank 37. The device 31 is used with various products and/or variable flow rates. The vessel 31 is sized for the maximum needed residence time and is preferably open to atmosphere. The mixing chamber 37 incorporates a motor 53 connected to a batch shear mixer 55 in a tank 37. A level controller 41 controls a valve 43 or a positive displacement pump at the inlet 45. Systems are designed for use with various products and flow rates by sizing the mixing chamber 37 for the maximum needed residence time, opening the vessel to the atmosphere and installing a level monitor 41 in the tank 37. The volume, determined by the level, serves as a controlled process variable for residence time control. A variable speed extraction pump 47 controls the level on a closed loop control. When the incoming flow rate matches the outgoing, the conditions are met for continuous processing.

The basic device includes a control valve 43 connected between the product inlet 45 and the holding tank 37 for controlling a level 49 of the product in the product holding tank 37, a level controller 41 connected to the product holding tank 37 and to the control valve 43 for controlling the control valve 43, an inlet pump 33 connected between the product inlet 45 and the control valve 43 for supplying the product to the control valve 43 and to the holding tank 37. The inlet pump 33 is preferably a centrifugal pump. This embodiment may also include an outlet pump 47 connected between the holding tank 37 and a product outlet 51 for pumping the product out of the holding tank 37. The outlet pump 47 is preferably a centrifugal pump. The control valve 43 is connected near a top 35 of the holding tank 37 and the outlet pump 47 and the product outlet 51 are connected near a bottom 39 of the holding tank 37.

Figure 3:
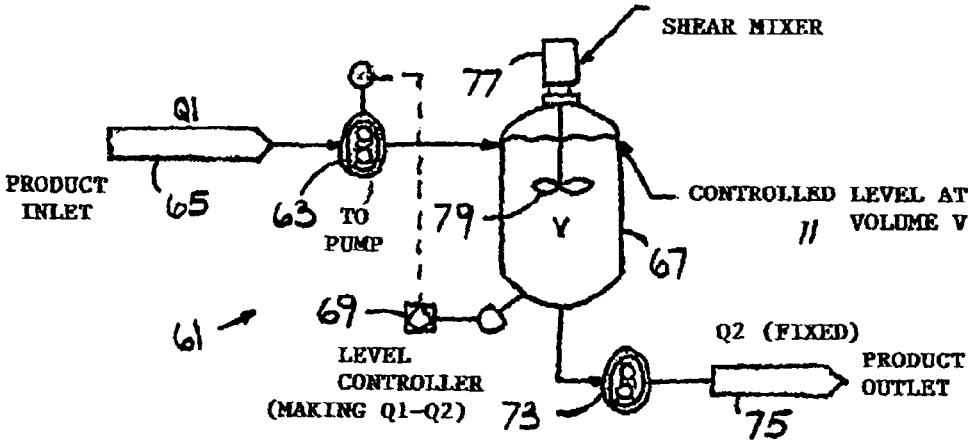
FIG. 3 is a schematic diagram of a variable flow embodiment for high viscosity.
Figure 4:
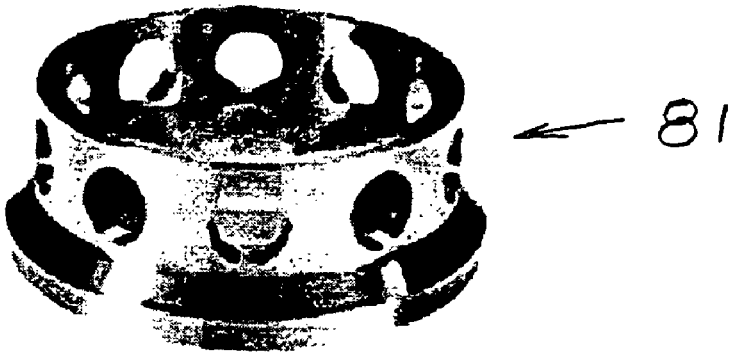
FIGS. 4, 5, and 6 show various shearheads.
Figure 5:
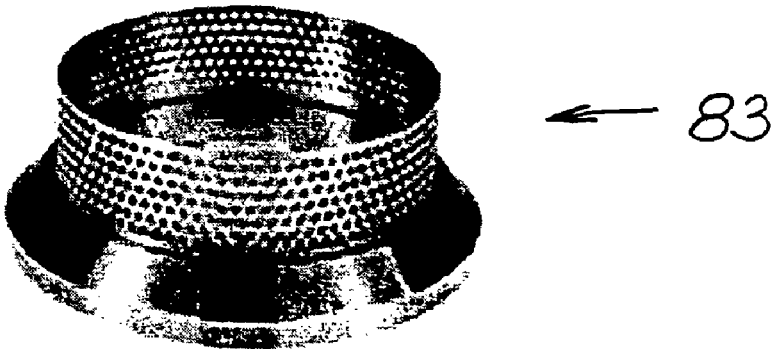
Figure 6:
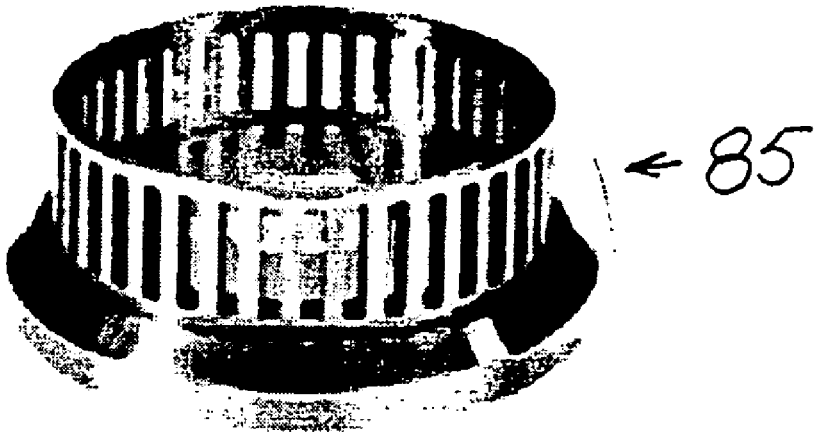

FIG. 3 is a schematic diagram of a variable flow embodiment 61 for high viscosity. This embodiment adds to the basic device a positive displacement pump 63 connected between a product inlet 65 and a holding tank 67, a level controller 69 connected to the holding tank 67 and connected to the inlet positive displacement pump 63 for controlling liquid level 71 in the holding tank 67, and an outlet positive displacement pump 73 connected between the holding tank 67 and a product outlet 75. A motor 77 controls a high shear mixer 79 in the holding tank FIGS. 4, 5, and 6 show large hole, small hole, and slotted shearing heads 81, 83, 85 with central openings.

Figure 7:
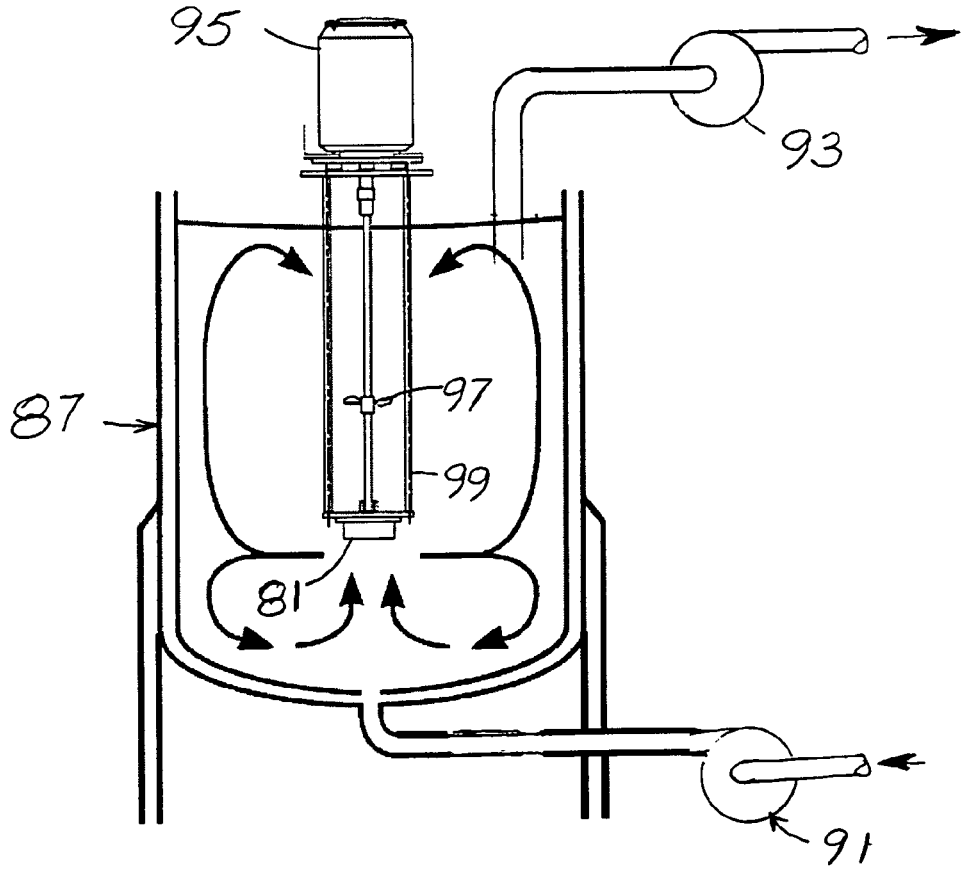
FIG. 7 shows an atmospheric residence tank.

FIG. 7 shows an atmospheric residence tank 87 with coordinated inlet and outlet pumps 91, 93, shearhead motor 95, a shear mixer 97 in a screen 99 and a shearhead 81, 83, or 85.

The present invention also includes a method of providing juice or beverages or any other product that requires homogenization, reduction of particle size, blending, solubilizing, dispersion, suspension, or emulsification. The process includes providing a product inlet, providing a holding tank connected to the product inlet, providing a product shear mixer mounted in the holding tank, providing a motor connected to the shear mixer for rotating the shear mixer in the holding tank, providing a product outlet connected to the holding tank for continuously and constantly flowing the product from the holding tank, and providing ingredient injector connected to the product inlet near the holding tank. The holding tank has a top and a bottom and the product inlet is connected near a bottom of the holding tank and the product outlet is connected near a top of the tank.

A residence time T is determined. The residence time T in the holding tank is determined with the following equation: $T=V/Q$, where V is the volume of product in gallons within the holding tank, Q is the output flow rate of the product output in gallons per minute, and T is the residence time within the tank in minutes.

In an alternative embodiment, the basic method also includes providing a control valve connected between the product inlet and the holding tank for controlling a level of the product in the product holding tank, providing a level controller connected to the product holding tank and to the control valve for controlling the control valve, providing an inlet pump connected between the product inlet and the control valve for supplying the product to the control valve and to the holding tank, wherein the inlet pump is a centrifugal pump, providing an outlet pump connected between the holding tank and the product outlet for pumping the product out of the holding tank, wherein the outlet pump is a centrifugal pump, and wherein the control valve is connected near a top of the holding tank and the outlet pump and the product outlet are connected near a bottom of the holding tank.

In this embodiment, $Q=Q_1=Q_2$, where Q is the output flow rate of the product output in gallons per minute, $Q_1$ is the input flow rate in gallons per minute and $Q_2$ is a fixed output rate in gallons per minute.

In an alternative embodiment, the basic method also includes providing a positive displacement pump connected between the product inlet and the holding tank, providing a level controller connected to the holding tank and connected to the inlet positive displacement pump for controlling liquid level in the holding tank, and providing an outlet positive displacement pump connected between the holding tank and the product outlet.

Here, $Q=Q_1=Q_2$, where Q is the output flow rate of the product output in gallons per minute, $Q_1$ is the input flow rate in gallons per minute and $Q_2$ is a fixed output rate in gallons per minute.

In addition to particle size reduction and viscosity applications, dry solids incorporation is aided by mixing with predetermined residence times. Oil based flavor additives injected into juice streams benefit by employing predictable and adequate residence times to ensure two phase emulsions. Where multiple stage homogenizations are required to achieve a specific size emulsion, shear mixing with residence time makes single stage homogenization viable.

The present invention allows replacement of conventional homogenization with lower capital costs and energy savings.

While the invention has been described with reference to specific embodiments, modifications and variations of the invention may be constructed without departing from the scope of the invention.

The invention claimed is:

1. A continuous material treatment system comprising:

a holding tank, a continuous and constant inflow line at the bottom of the holding tank, a positive displacement pump in the flow line, a level sensor in the tank and connected to the positive displacement pump to insure a constant continuous level and flow of the material in and through the tank, a continuous and constant outflow line at a top of the holding tank, a high shear mixer in the holding tank, a motor connected for driving the high speed mixer, the tank having sufficient volume for holding the material flowing through the holding tank for a sufficient time to provide constant and maximum residence time for required blending, particle reducing, homogenizing, emulsifying, disintegrating, dissolving, agglomerate dividing or dispersing materials in the treatment system;

a shaft connected to the motor and to the high shear mixer, a shearhead having an end fixed to the shaft and having a cylinder with large holes, small holes or slots connected to the end of the shearhead that is fixed to the shaft.

2. The apparatus of claim 1, wherein the holding tank has a top and a bottom and the product inlet is connected near a bottom of the holding tank and the product outlet is connected near a top of the tank.

3. The apparatus of claim 2, further comprising a metered ingredient injector connected to the product inlet near the holding tank.

4. The apparatus of claim 1, wherein the pump is an inlet pump and a control valve is connected between the inlet pump and the holding tank and is adapted to provide the holding tank with a constant flow of the product into the product holding tank, and a level controller connected to the level monitor in the product holding tank and to the control valve or the inlet pump for controlling the control valve to maintain the constant volume of the product in the holding tank.

5. The apparatus of claim 4, wherein the inlet pump is connected between the product inlet and the control valve for supplying the product to the control valve and to the holding tank.

6. The apparatus of claim 5, wherein the inlet pump is a centrifugal pump.

7. The apparatus of claim 4, further comprising an outlet pump connected between the holding tank and the product outlet and connected to the inlet pump for coordinated pumping of the product into, through and out of the holding tank in a constant flow.

8. The apparatus of claim 7, wherein the outlet pump is a centrifugal pump.

9. The apparatus of claim 7, wherein the control valve is connected near a top of the holding tank and the outlet pump and the product outlet are connected near a bottom of the holding tank.

10. The apparatus of claim 1, further comprising a level controller connected to the holding tank and connected to the positive displacement pump for controlling constant liquid volume in the holding tank.

11. The apparatus of claim 10, further comprising an outlet positive displacement pump connected between the holding tank and the product outlet.

12. The apparatus of claim 1, wherein the holding tank is pressurized and no outlet pump is necessary.

13. The system of claim 1, further comprising a cylindrical screen around the shaft and the shear mixer with the shearhead exposed at a bottom of the screen for circulating the material through the tank and through the screen.

* * * * *